United States Patent [19]

Yang

[11] Patent Number: 4,753,425

[45] Date of Patent: Jun. 28, 1988

[54] INTERCONNECTED C-CLAMPS AND TENSIONING MEANS THEREFOR

[76] Inventor: Tai-Her Yang, 5-1 Taipin St., Si-Hu Town, Dzan-Hwa, Taiwan

[21] Appl. No.: 886,901

[22] Filed: Jul. 18, 1986

[51] Int. Cl.[4] ..... B25B 1/00

[52] U.S. Cl. ..... 269/45; 269/88; 269/249

[58] Field of Search ..... 269/45, 88, 249, 97, 269/98, 99, 100, 91, 93, 152–156, 90 D; 248/231.7, 229; 24/341, 486, 525

[56] References Cited

U.S. PATENT DOCUMENTS

| | | | |
|---|---|---|---|
| 1,126,053 | 1/1915 | McGough | 269/45 |
| 2,466,518 | 4/1949 | Wagner | 269/91 |
| 2,553,802 | 5/1951 | Woods | 269/249 |
| 2,606,583 | 8/1952 | O'Connor | 269/93 |
| 2,636,527 | 4/1953 | Schiemann | 269/97 |
| 2,661,783 | 12/1953 | Caston | 269/91 |
| 2,669,958 | 2/1954 | Sweeney | 269/45 |
| 2,778,393 | 1/1957 | Golasowski | 269/97 |
| 3,883,128 | 5/1975 | Breese | 269/45 |
| 3,934,316 | 1/1976 | Driscoll | 269/249 |
| 4,256,295 | 3/1981 | Egner | 269/45 |
| 4,607,829 | 8/1986 | Suska | 269/249 |

*Primary Examiner*—Robert C. Watson
*Attorney, Agent, or Firm*—Leonard Bloom

[57] ABSTRACT

A C-clamp adapted for interconnection to other like C-clamps and to other tensioning devices by means of at least one threaded adapter. The clamp includes a substantially L-shaped main body having a threaded clamping rod. The main body includes three legs. The third leg is intermediate between the first and second legs and disposed at substantially a 45 degree angle thereto. The second leg has a truncated end and a blind bore therein. The first and second legs have tapped apertures perpendicular to the plane of the main body. The third leg has a tapped aperture formed therein along an axis which is within the plane of the main body portion of the clamp at substantially a 45 degree angle with respect to the blind bore. Threaded adaptors and other tensioning devices are interconnected between individual C-clamps permitting intricate clamping arrays for objects or workpieces having complex shapes.

2 Claims, 14 Drawing Sheets

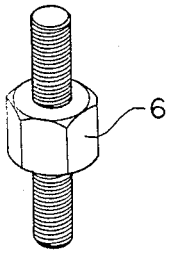
ig. 8
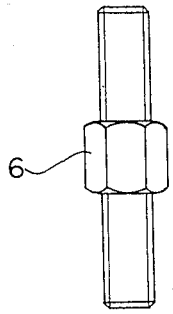
ig. 8-1
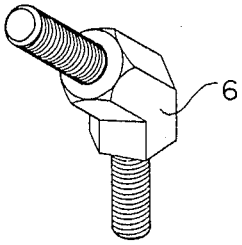
ig. 9
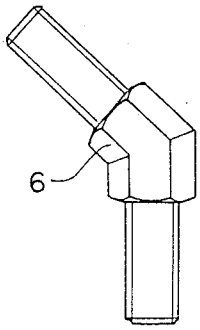
ig. 9-1
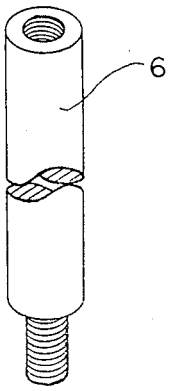
ig. 10
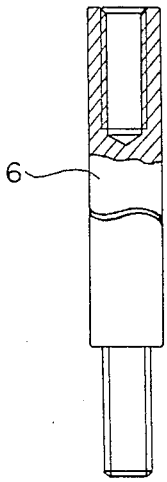
ig. 10-1

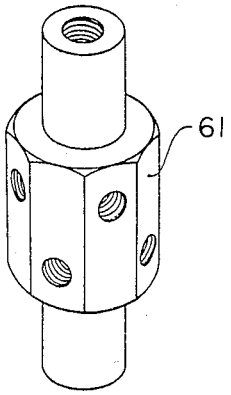
ig. 11
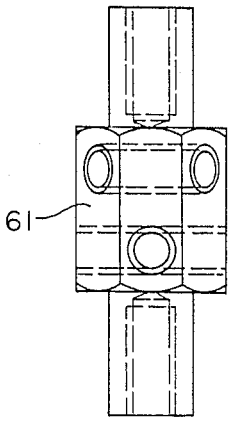
ig. 11-1
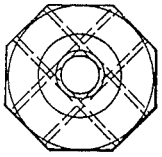
ig. 11-2
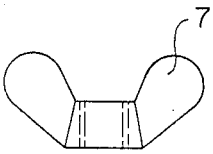
ig. 12-1
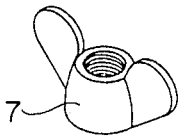
ig. 12

INTERCONNECTED C-CLAMPS AND TENSIONING MEANS THEREFOR

SUMMARY OF THE INVENTION

This is an improvement on a C type clamp. Its features are that a C type shaft shapes in a whole body style, or a half-section style, or a connected multiple-sided column style, or an angle adjustable clamp set that consists of two L typle bars connected together by a multiple-sided column. On four sides or multiple sides and corner places, there are several threaded holes that are intended to connect other half-section style C clamp shaft or to connect a central connection buckle. The shape of an object to be clamped with this invented C clamp may be any of the multiple-angled, non-paralleled surfaces, or paralleled surfaces.

BRIEF DESCRIPTION OF THE DRAWING

FIG. A: An implementation example of this invention using various C clamps and central connection buckles to grip an object.

FIG. B: The first implementation example of this invention using a connection buckle to expand the gripping distance (width).

FIG. C: The second implementation example of this invention using central connection buckles to expand the gripping distance (width).

FIG. D: The third implementation example of this invention using central connection buckles to expand the gripping distance (width).

Figure 1:
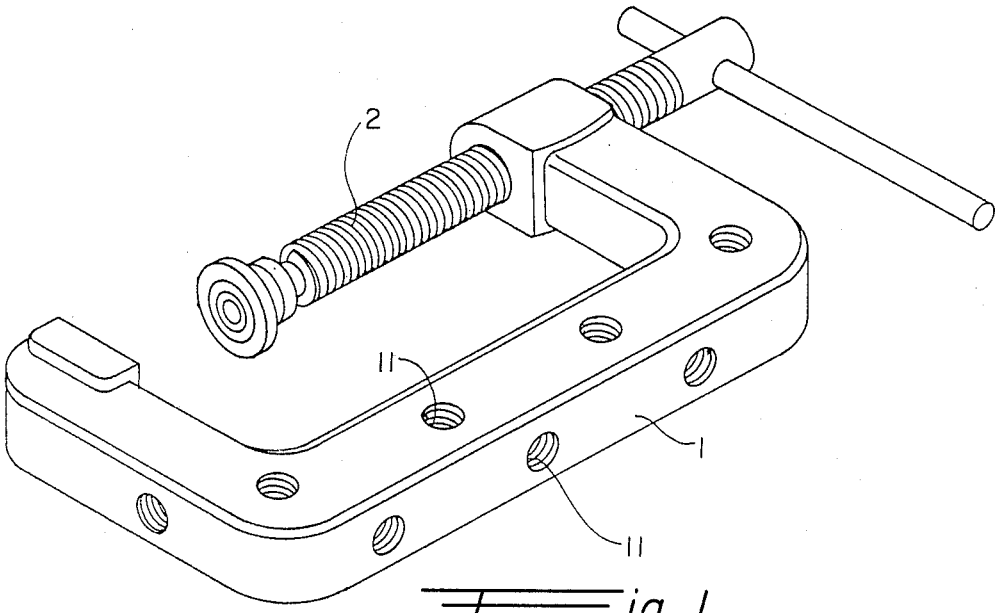
Figure 1:
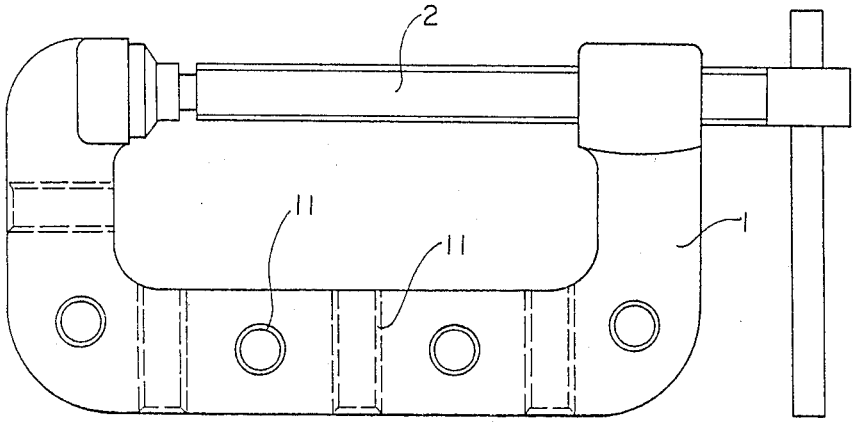

FIG. 1. A solid view of one bodied C clamp of this invention.

FIG. 1-1. A front view of FIG. 1.

Figure 2:
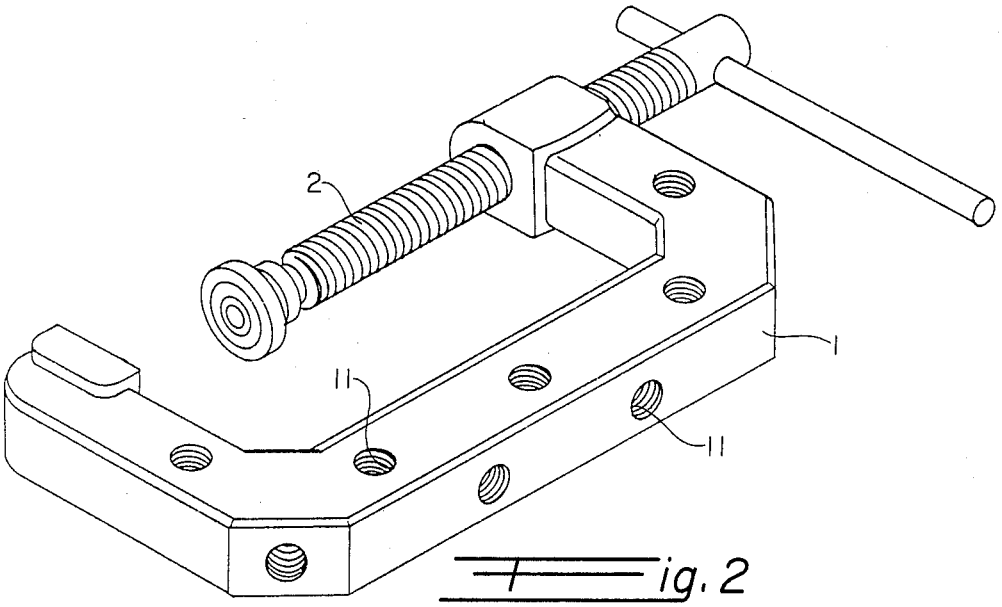
Figures 1, 2:
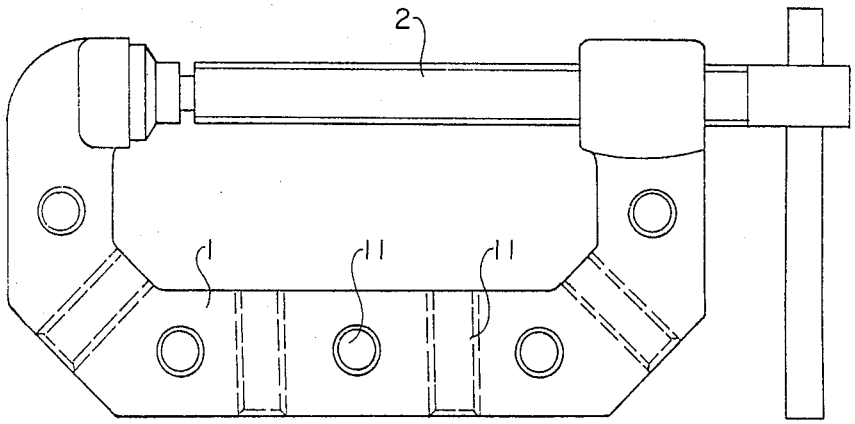

FIG. 2. A solid view of a C clamp of this invention that has a threaded hole at the turning corners.

FIG. 2-1. A front view of FIG. 2.

Figure 3:
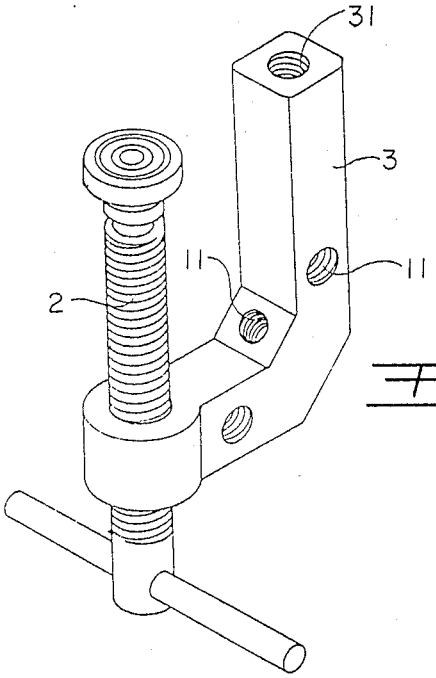
Figures 1, 3:
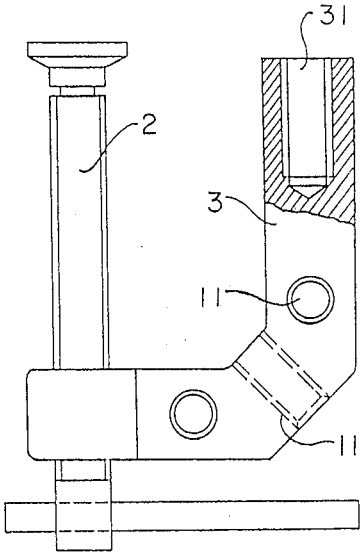
Figures 2, 3:
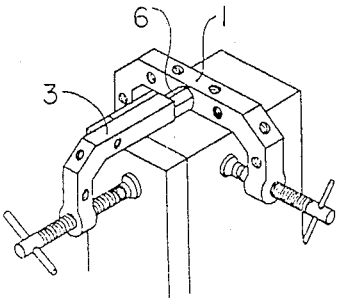

FIG. 3. A solid view of a half-section type C clamp of this invention.

FIG. 3-1. A front view of FIG. 3.

FIG. 1-2-3 An implementation example of a combination of an one-bodied and a half-section typle C clamps.

Figure 4:
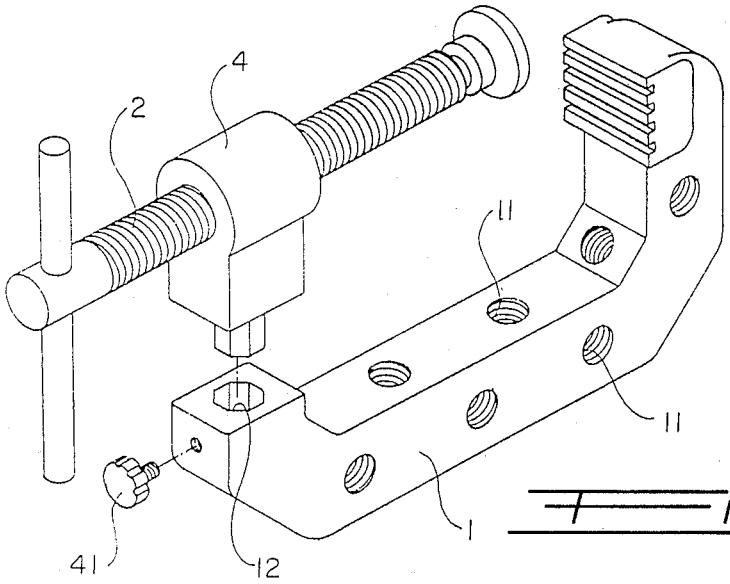
Figures 1, 4:
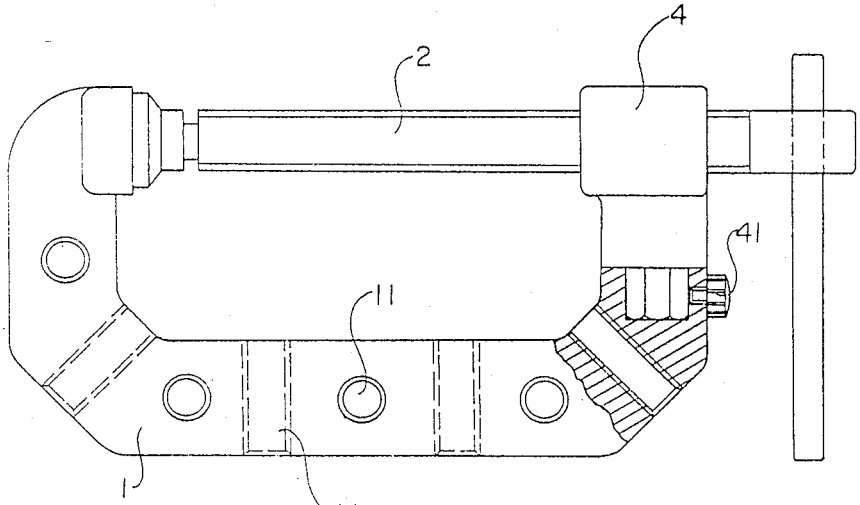
Figures 2, 4:
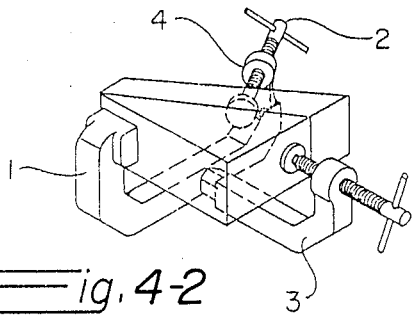

FIG. 4. A solid view of a C clamp of this invention by combining a multiple-sided column and a C clamp.

FIG. 4-1. A front view of FIG. 4.

FIG. 4-1-1 An implementation example of this invention by combining a C clamp and a half-section type C clamp connected with a multiple-sided column.

Figure 5:
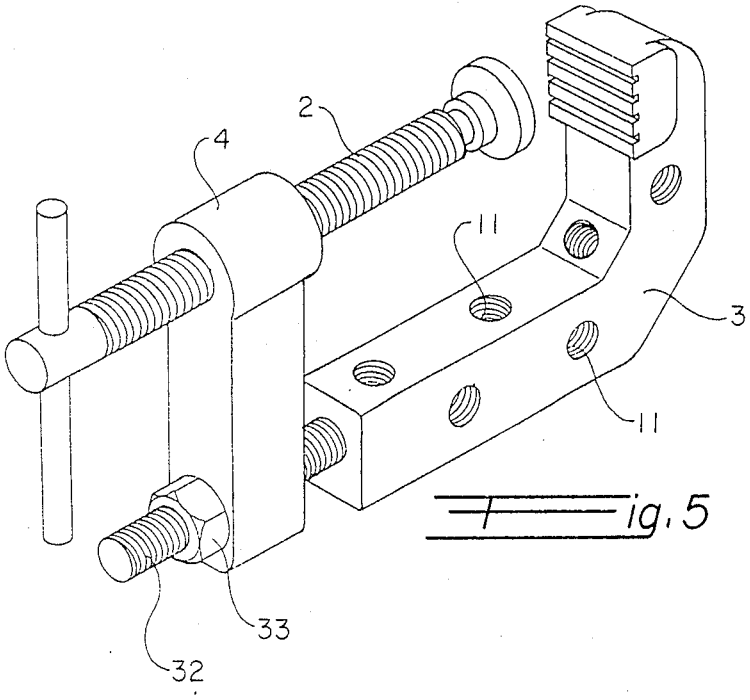
Figures 1, 5:
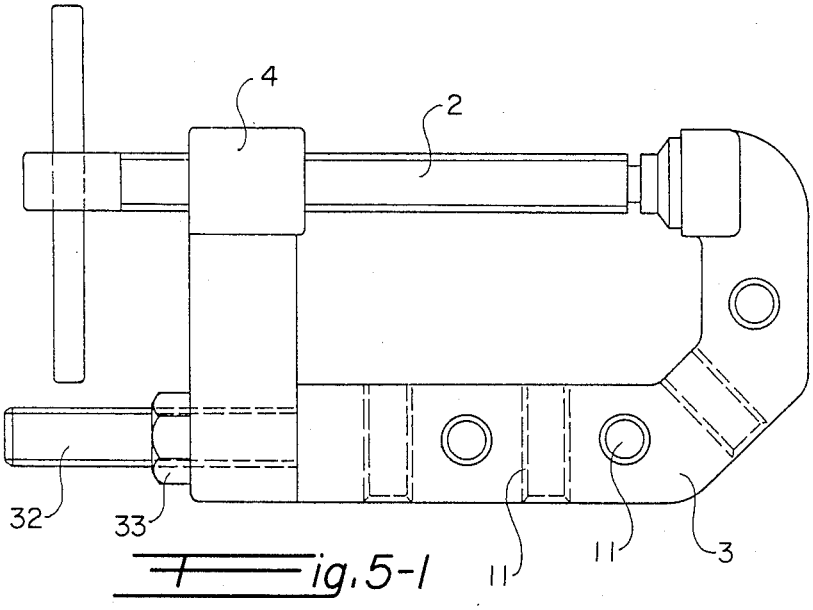
Figures 2, 5:
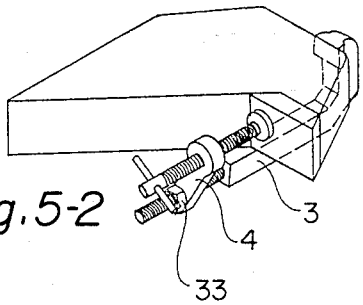

FIG. 5. A solid view of the L shaped clamp with a threaded connecting column.

FIG. 5-1. A front view of FIG. 5.

FIG. 5-2. An implementation example of this invention that the L shaped clamp is connected to a threaded connecting column which forms a C shape.

Figure 6:
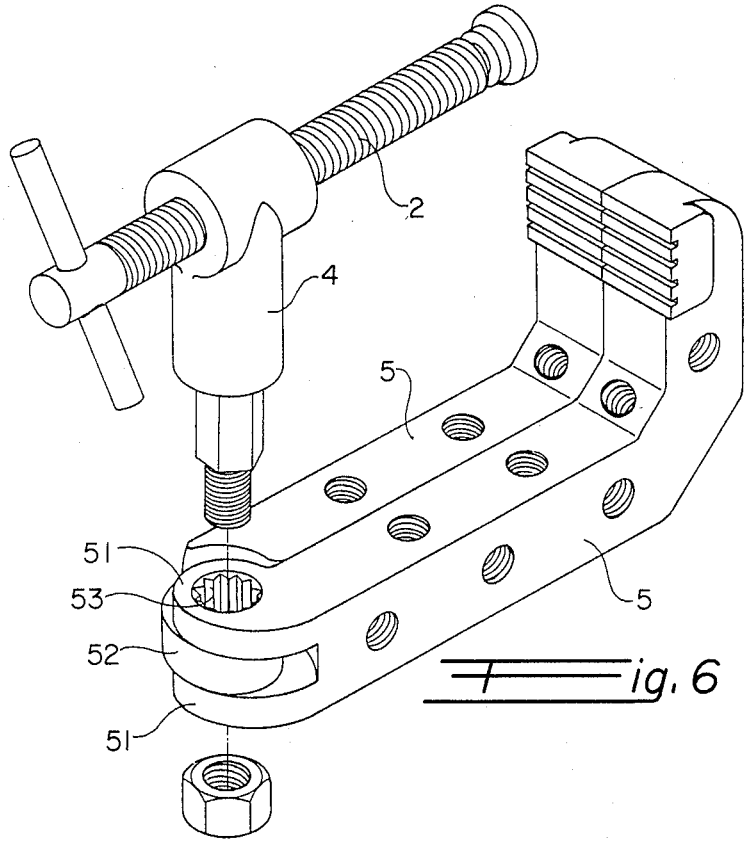
Figures 1, 6:
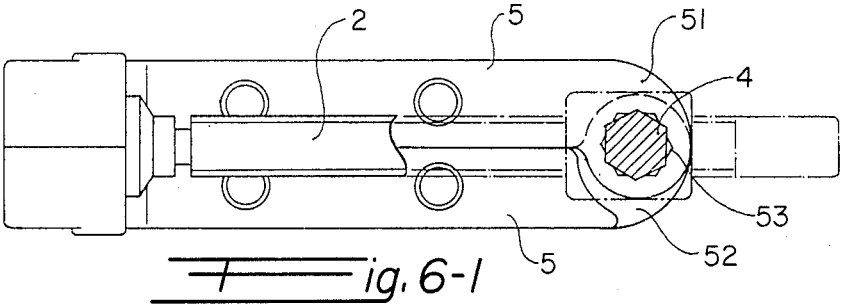
Figures 2, 6:
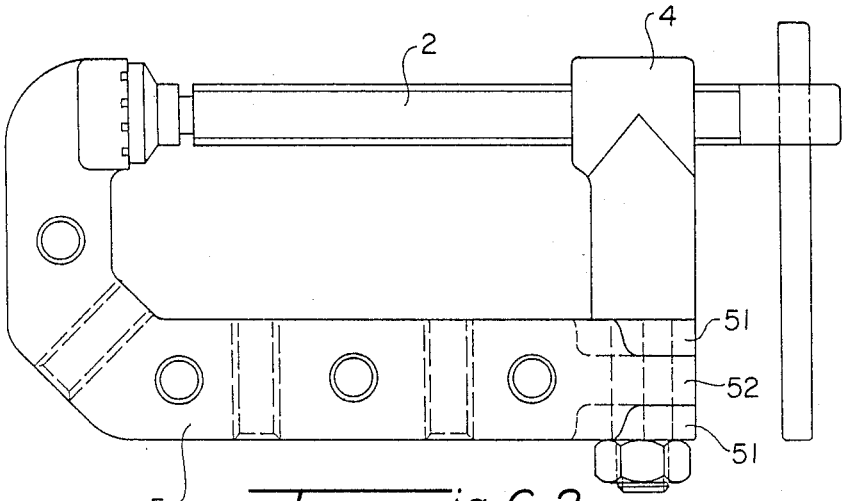
Figures 3, 6:
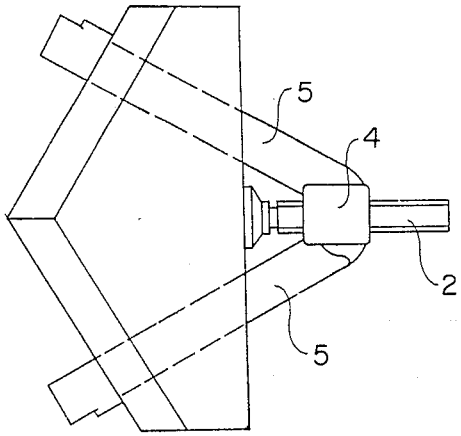

FIG. 6. A solid view of this invention that two L shaped clamps are connected with a connecting column which forms a C shape.

FIG. 6-1. A top view of FIG. 6.

FIG. 6-2. A front view of FIG. 6.

FIG. 6-3. An implementation example of this invention that two L shaped clamps constitute a C clamp.

Figure 7:
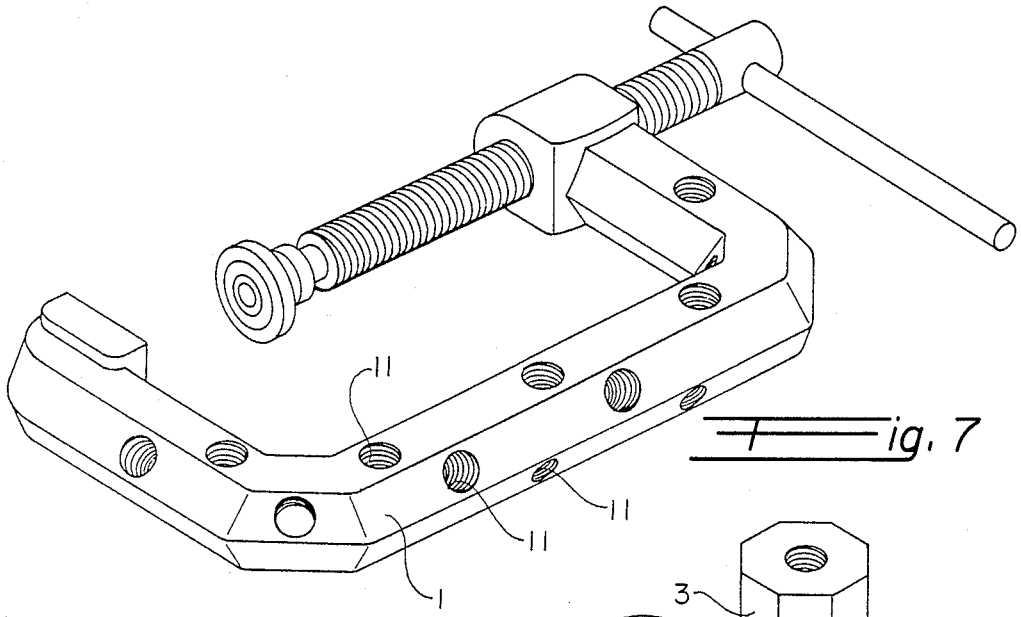
Figures 2, 7:
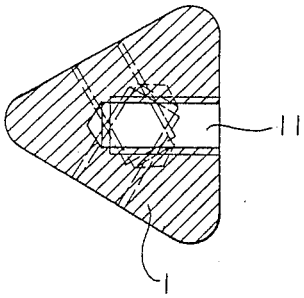
Figures 1, 7:
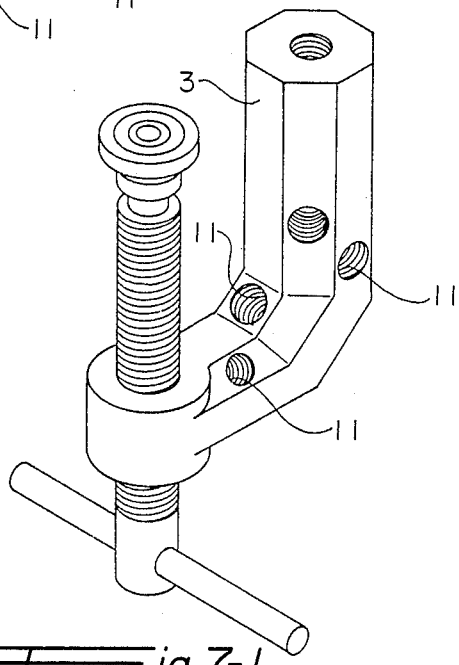

FIG. 7. A solid view of this invention that a C clamp shapes a hexagonal sectional view with a threaded holes that are not piercing through.

FIG. 7-1. A solid view of this invention that the L shaped clamp has an sectional view with a threaded holes that are not piercing through.

FIG. 7-2. A triangle sectional view of a C clamp of this invention.

FIG. 8. One of a central connection buckle of this invention (1).

FIG. 8-1. A front view of FIG. 8.

FIG. 9. One of a central connection buckle of this invention (2).

FIG. 9-1. A front view of FIG. 9.

FIG. 10. One of a central connection buckle of this invention (3).

FIG. 10-1. A front view of FIG. 10.

FIG. 11. One of a central connection buckle of this invention (4).

FIG. 11-1. A front view of FIG. 11.

FIG. 11-2. A side view of FIG. 11.

FIG. 12. A solid view of a turning screw of this invention.

FIG. 12-1. A front view of FIG. 12.

DETAILED DESCRIPTION OF THE INVENTION

A traditional C type clamp consists of a whole C type shaft; its one end is screwed in with a penetrating screw shaft, posing as a compressive clip structure. It can be effective when the object to be clamped has two paralleled surfaces. But in other various processing and assembling circumstances, if it is needed to clamp several object at the same time and the object has non-paralleled surfaces, then it needs several C clamp to fasten the object one by one. It results in too may clamps are on an object or an equipment. It influences processing and inconvenient for the refinery operation.

This invention supplies an indipendent or an assembled, connected multiple-direction, multiple-angled non-paralleled surface gripping function. It may be applied to processing or assembling operation. With less clamps and simpler mechanism for fastening simultaneously.

Figure 13:
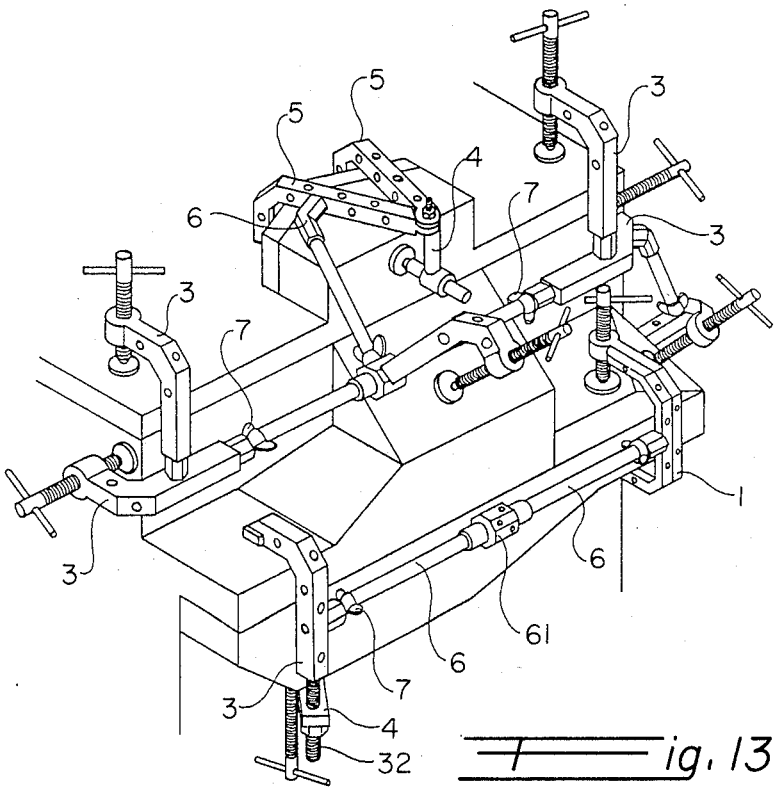

Now, the detailed explanation of implementation examples of this invention are given as follows in the order of appendix figures:

As shown in FIG. 13, when an object which is intended to be clamped is a several pieces combination and its multiple clamping surfaces are unparalleled or are multiple shape combination surfaces, it must need many traditional C clamps and do it one by one. Fortunately, with this newly invented improved C type clamp, the work can be completely done in one action with an entire body method C clamp or a half-section method C clamp or a half-section method C clamp with an adjustible corner angle or expandable two fixed jaws, or screw the central connection buckle into the threaded holes on a C clamp main body. Thus the clamping operation can be elastically adjusted to meet the object variation, and finish the clamping work to be performed in one manipulation.

Figure 14:
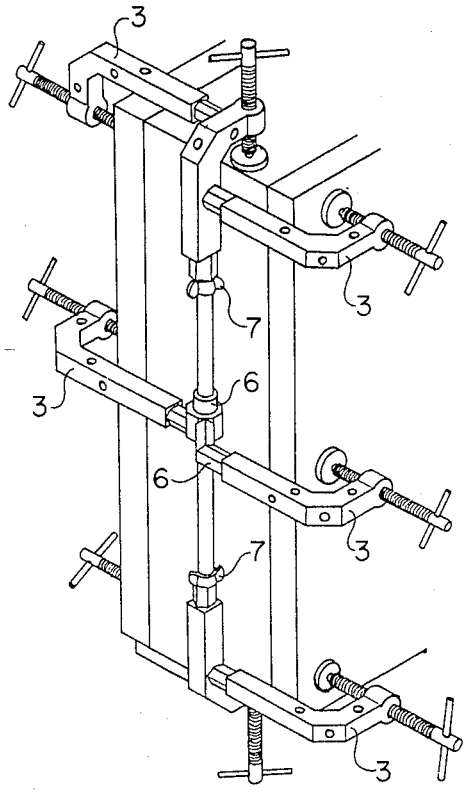

As shown in FIG. 14, using this newly invented improved C clamp to clamp the multiple-layered huge object, it can be done easily by adding a turnbuckle to connect central connection buckles or a turning corner extention bar to connect several half section C clamps, or an angle adjustible half section type C clamps. With the help of central connection buckles, gripping width and direction may be adjusted.

Figure 16:
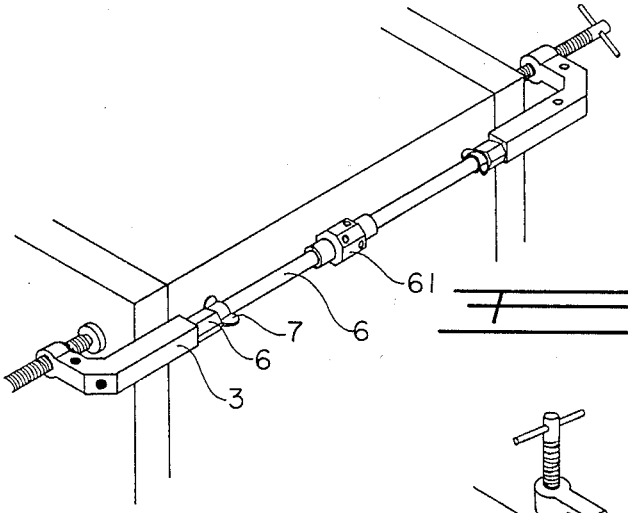
Figure 15:
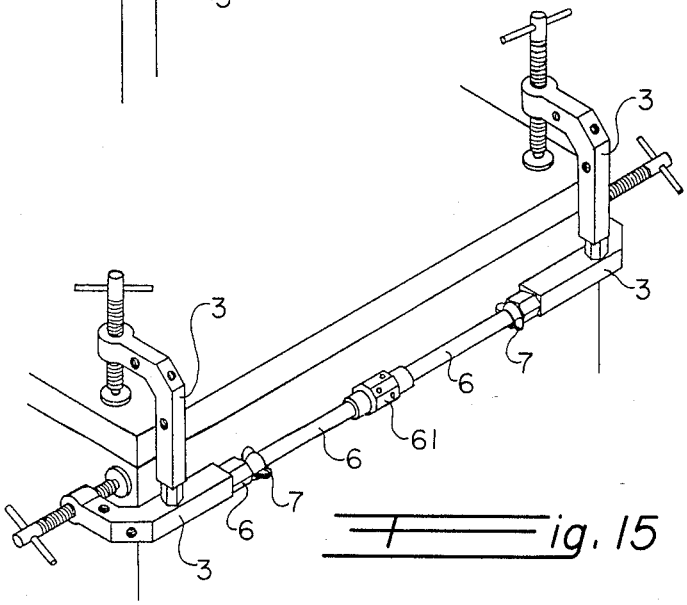

As shown in FIG. 15 and 16, the gripping points may be decided by the selection and adjustment of the central connection buckles.

It may grip on two surfaces or three surfaces. Using an extention function of the central connection buckles and tightly screwed effect of a turnbuckle, connecting several same size half section clamps or an one bodied C clamp may finish the work of clamping a big object.

FIG. 1 and FIG. 2 shows C type clamp by this invention. An one bodied style C clamp 1 shapes squarely, two turning corners are 45°. Several threaded holes 11 are drilled on it for connecting other half section style C clamp or connecting other extention bar using central connection buckles. The threaded holes 11 on the various surfaces are made in interplay position, so that it does not affect the structure strength of C clamp 1.

FIG. 3 shows a half section typle C clamp of this invention. It consists of L shaped clamp 3 and a penetrating screw shaft 2. On the top of a L shaped clamp 3, a threaded hole 31 or a protruding threaded bar is made. On the L shaped clamp body 3, several threaded holes 11 facing different directions are made.

With reference to FIGS. 3 and 3-1 of the drawings, a preferred embodiment of the invention is clearly illustrated, wherein a C-clamp is adapted for interconnection to other C-clamps and tensioning devices. This preferred C-clamp comprises, in combination, a substantially L-shaped main body portion including a first leg having a boss portion provided with a threaded recess therein. A threaded clamping rod is received in the threaded recess; and the threaded rod has a pair of ends, one of which ends is provided with a handle and the other of which ends is provided with a clamping member. The main body portion includes a second leg having a longitudinal axis substantially parallel to the threaded rod; the main body portion further includes a third leg intermediately of the first and second legs and disposed substantially at a 45° angle thereto, respectively. The second leg is truncated and has a free end portion provided with a blind bore formed therein substantially coincident with the longitudinal axis of the second leg. In this manner, the C-clamp may be interconnected to other C-clamps by means of a threaded adapter. At least one of the first and second legs further has a tapped aperture formed therein on an axis which is perpendicular to the plane of the main body portion; and the third leg has a tapped aperture formed therein along an axis which is within the plane of the main body portion of the C-clamp, thereby further facilitating the interconnection of the C-clamp to other tensioning devices.

Preferably, the first and second legs each has a tapped aperture formed therein about respective axes which are perpendicular to the plane of the main body portion of the C-clamp.

The above C clamp and a half section C clamp may be combined together as shown in FIG. 1-2-3. The L shaped clamp of a half section C clamp 3 is connected directly to an one bodied C clamp or indirectly through a central connection buckle. It shapes a triangle, three points clamp. The clamp point of a half section C clamp and the clamping line of the one bodied C clamp are posing vertical to each other.

As shown in FIG. 4, the compressing clamp point of a C clamp of this invention is not on the extended line of a threaded shaft. A penetrating threaded shaft 2 is piercing a connecting column 4. On the other side of a connecting column 4, there is a multiple-sided (hexagonal or octagonal) column body, to be inserted to a connecting end of a C clamp 1. On a connecting end of a C clamp, a multiple-sided (hexagonal or octagonal) column hole 12 is made. On the side of this column hole 12, a side screw hole is made for a lock screw 41.

By releasing a lock screw 41, a connecting column 4 may be pulled out and by matching the object, the corner angle of a connecting column 4 and a C clamp 1 can be re-adjusted and re-locked again. On the various surfaces of a C clamp 1, there are several threaded holes 11 with different angle directions to connect other half-section C clamp.

As shown in 4-1-1, it is one design of this invention. A half-section C clamp and an original C clamp are connected together through a connecting column 4 which can adjust its angle. It grips three points of the three surfaces (such as triangle, irregular square, etc). This is its specific feature.

One step forward, this design may have a half-section C clamp. The L shaped clamp 3, connects a proper length threaded extention shaft 32 on its top as shown in FIG. 5, FIG. 5-1. On a longer connecting column 4, make a threaded lead hole or an adjustable threaded hole for a penetrating threaded shaft 2. A threaded shaft 32 may be installed in the adjustable threaded hole. It may be pre-locked by a nut 33 after adjusting to the width of an object. Firm grip can be made by tightening a penetrating threaded shaft 2. This structure may be applied to grip two points not on a line but on the paralleled surfaces as shown in FIG. 5-2. A connecting column 4 may turn and extend or contract around the threaded extention shaft 32 that overreaching from L shaped shaft 3. It enables to grip any two points on two paralleled surfaces.

One step forward, this invention may designed to be a clamp set by installing two L shaped clamps together using one connecting column, as shown in FIG. 6, FIG. 6-1, FIG. 6-2.

On the non-clamp ends of L shaped clamps 5, make two protruding ears 51 facing the same direction on one L shaped clamp and make another one protruding ear 52 on the middle of the other L shaped clamp. Put ears 51 and 52 in layers, and make a vertical multiple-sided openning 53 to insert a connecting multiple sided column 4. Extend a threaded shaft under the end of a connecting multiple-sided column 4.

After it is inserted into a multiple-sided hole 53, a nut is screwed to it. Thus, two L shaped clamp 5 and a connecting column 4 are installed together to be one clamp.

These two L shaped clamps 5 may be expanded to match the shape of the working object and its gripping ends touch the object. Place ears 51 and ear 52 on layers, lock the connecting column 4. Tighten the grip using a penetrating screw shaft, as shown in FIG. 6-3.

All C clamp 1 or various L shaped clamp 3 that stated in the above may shape as a rectangular clamp. On its clamp shaft surfaces or corners, several threaded holes 11 are drilled for screwing other sets of L shaped clamps 3 or central connection buckles. One step forward, C clamp 1 and L shaped clamps or L shaped clamps 5 may have a multiple-sided shape sectional view as shown in FIG. 7, FIG. 7-1 and FIG. 7-2. But the threaded holes 11 are not piercing through the clamp.

Another specific feature of this invention is that at the ends of all C clamp 1, L shaped clamp 3 or L shaped clamps 5, there are threaded holes 31 or protruding threaded shaft 32. They may be fitted to connect central connection buckles 6 as shown in FIG. 8, FIG. 9, FIG. 10. A central connection buckle 6 is used to extend or change direction. The central connection buckles include a hexagonal column at its central part or one end is threaded and the other end is drilled as a threaded hole.

One step forward, a central connection buckle 6 may have other designs as shown in FIG. 11, FIG. 11-1, FIG. 11-2. A multiple-sided column 61 divides a central connection buckle. On each flat surface of the multiple-sided column 61, threaded holes may be made to lock an L shaped clamp 3 or a connection buckle 6.

At the combining point of a central connection buckle 6 and a C clamp or an L shaped clamp, or another central connection buckle 6, a turning screw nut 7 may be made as shown in FIG. 12, FIG. 12-1. This turning screw nut may tighten a central connection buckle 6 to other connecting end to perform clamping work.

I claim:

1. A C-clamp adapted for interconnection to other like C-clamps and to other tensioning devices by means of at least one threaded adapter and comprising, in combination, a substantially L-shaped main body portion including a first leg having a boss portion provided with a threaded recess therein, a threaded clamping rod received in the threaded recess, the threaded rod having a pair of ends, one of which ends is provided with a handle and the other of which ends is provided with a clamping member, the main body portion further including a second leg having a longitudinal axis substantially parallel to the threaded rod, the main body portion further including a third leg intermediately of the first and second legs and disposed substantially at a 45° angle thereto, respectively, the second leg being truncated and having a free end portion provided with a blind bore formed therein substantially coincident with the longitudinal axis of the second leg, whereby the C-clamp may be interconnected to other like C-clamps by means of at least one threaded adapter, at least one of the first and second legs further having a tapped aperture formed therein on an axis which is perpendicular to the plane of the main body portion, and the third leg having a tapped aperture formed therein along an axis which is within the plane of the main body portion of the C-clamp at substantially a 45° angle with respect to said blind bore, to other like C-clamps and to other tensioning devices with an externally threaded adapter.

2. The combination of claim 1, wherein both the first and second legs each has a tapped aperture formed therein about respective axes which are perpendicular to the plane of the main body portion of the C-clamp.

* * * * *